US008368534B2

(12) United States Patent
Crutcher et al.

(10) Patent No.: US 8,368,534 B2
(45) Date of Patent: Feb. 5, 2013

(54) OPTICAL FIBER SYSTEMS AND METHODS FOR MONITORING REMOTE DOOR ACCESS

(75) Inventors: W. Larkin Crutcher, Plano, TX (US); Anil Kumar Trehan, Plano, TX (US)

(73) Assignee: CommScope Inc. of North Carolina, Hickory, NC (US)

( * ) Notice: Subject to any disclaimer, the term of this patent is extended or adjusted under 35 U.S.C. 154(b) by 476 days.

(21) Appl. No.: 12/474,384

(22) Filed: May 29, 2009

(65) Prior Publication Data

US 2009/0295579 A1 Dec. 3, 2009

Related U.S. Application Data

(60) Provisional application No. 61/056,878, filed on May 29, 2008.

(51) Int. Cl.
*G08B 13/08* (2006.01)

(52) U.S. Cl. ..... 340/545.3; 340/542; 340/545.1; 340/555; 340/541; 340/545.2

(58) Field of Classification Search ..... 340/542, 340/545.1, 545.2, 545.3, 555, 556
See application file for complete search history.

(56) References Cited

U.S. PATENT DOCUMENTS

| | | | | |
|---|---|---|---|---|
| 4,174,149 | A * | 11/1979 | Rupp | 398/40 |
| 4,292,628 | A * | 9/1981 | Sadler | 340/531 |
| 4,636,029 | A * | 1/1987 | Johansson et al. | 398/40 |
| 5,684,671 | A * | 11/1997 | Hobbs et al. | 361/679.57 |
| 6,002,501 | A * | 12/1999 | Smith et al. | 398/9 |
| 6,262,415 | B1 * | 7/2001 | Goldner | 250/227.11 |
| 6,411,215 | B1 * | 6/2002 | Shnier | 340/686.1 |
| 6,415,150 | B1 * | 7/2002 | Owens et al. | 455/445 |
| 6,507,278 | B1 * | 1/2003 | Brunetti et al. | 340/541 |
| 6,900,726 | B2 * | 5/2005 | Graves | 340/531 |
| 6,927,690 | B2 * | 8/2005 | Wilson | 340/545.3 |
| 6,937,151 | B1 * | 8/2005 | Tapanes | 340/550 |
| 6,975,220 | B1 * | 12/2005 | Foodman et al. | 340/531 |
| 7,469,102 | B2 * | 12/2008 | Lee et al. | 398/79 |
| 7,488,929 | B2 * | 2/2009 | Townley-Smith et al. | 250/227.14 |
| 7,514,670 | B2 * | 4/2009 | Anderson et al. | 250/227.14 |
| 7,782,196 | B2 * | 8/2010 | Piper et al. | 340/541 |
| 7,852,213 | B2 * | 12/2010 | Browning et al. | 340/555 |
| 7,956,316 | B2 * | 6/2011 | Browning et al. | 250/221 |
| 2006/0093359 | A1 * | 5/2006 | Lee et al. | 398/70 |

* cited by examiner

*Primary Examiner* — Daniel Wu
*Assistant Examiner* — Son M Tang
(74) *Attorney, Agent, or Firm* — Myers Bigel Sibley & Sajovec, P.A.

(57) ABSTRACT

A remote door access monitoring system includes a central monitoring component and a remote monitoring component. The central monitoring component includes an optical source, an optical power level receiver, and a microcontroller. The optical power level receiver is in communication with the microcontroller. The remote monitoring component includes an optical switch that is operably associated with a door of a communications equipment cabinet. The communications equipment cabinet is located at a geographical location different from a geographical location of the central monitoring component. The optical source transmits an optical signal from the optical source to the optical switch and back to the optical power level receiver. The optical switch attenuates the optical signal in response to opening and closing of the door. The optical power level receiver is configured to detect an attenuated optical signal and then notify the microcontroller of the existence of an attenuated optical signal.

5 Claims, 4 Drawing Sheets

OPTICAL FIBER SYSTEMS AND METHODS FOR MONITORING REMOTE DOOR ACCESS

RELATED APPLICATION

This application claims the benefit of and priority to U.S. Provisional Patent Application No. 61/056,878, filed May 29, 2008, the disclosure of which is incorporated herein by reference as if set forth in its entirety.

FIELD OF THE INVENTION

The present invention relates generally to monitoring the opening and closing of a door and, more particularly, to monitoring and detecting the unauthorized opening and closing of a door.

BACKGROUND

Many businesses have dedicated telecommunication systems that enable computers, telephones, facsimile machines and the like to communicate with each other through a private network and with remote locations via a communications service provider. In most buildings, the dedicated communications system is hard wired using telecommunication cables that contain conductive wires. In such hard wired systems, dedicated wires are coupled to individual service ports throughout the building. Conventionally, the wires from the dedicated service ports extend through the walls of the building to a communications closet or closets. The communications lines from the interface hub of a main frame computer or network and the telecommunication lines from external telecommunication service providers may also terminate within a communications closet. The communications line may comprise, for example, a communications cable or patch cord that contains four twisted pairs of conductors.

A patching system is typically used to interconnect the various telecommunication lines within a communications closet. In a communications patching system, the telecommunication lines are terminated within a communications closet or room in an organized manner. The organized terminations of the various lines are provided via the structure of the communications closet. One or more mounting frames having one or more racks of patch panels and other equipment are typically located in a communications closet.

Mounting frames within communications closets may include doors for controlling access to the equipment therewithin. Monitoring the opening and closing of communications equipment doors is useful in determining whether the security of the communications equipment has been violated or compromised.

SUMMARY

According to some embodiments of the present invention, a remote door access monitoring system includes a central monitoring component and a remote monitoring component. The central monitoring component includes an optical source, an optical power level receiver, and a microcontroller. The optical power level receiver is in communication with the microcontroller. The remote monitoring component includes an optical switch that is operably associated with a door of a communications equipment cabinet. The communications equipment cabinet is located at a geographical location different from a geographical location of the central monitoring component. The optical source transmits an optical signal from the optical source to the optical switch and back to the optical power level receiver. The optical switch attenuates the optical signal in response to the movement of the door (i.e., opening and closing of the door). The optical power level receiver is configured to detect an attenuated optical signal and then notify the microcontroller of the existence of an attenuated optical signal.

In some embodiments, the microcontroller sends an alarm signal to an administration system in response to receiving notification of an attenuated optical signal from the optical power level receiver. The alarm signal may be sent via electronic mail (e-mail), for example over an ethernet or other type of interface.

In some embodiments, the microcontroller activates a door intrusion relay contact closure and/or an alarm indicator light in response to receiving notification of an attenuated optical signal from the optical power level receiver. The intrusion relay serves to alert an operator of an open door condition.

According to other embodiments of the present invention, a remote door access monitoring system includes a central monitoring component and a remote monitoring component. The central monitoring component includes an optical source, an optical power level receiver, and a microcontroller. The optical power level receiver is in communication with the microcontroller. The remote monitoring component includes an optical switch operably associated with a door that is located at a geographical location different from a geographical location of the central monitoring component. The optical source transmits an optical signal from the optical source to the optical switch and back to the optical power level receiver via a single optical fiber. In some embodiments, optical signals travel bi-directionally through the optical fiber via a pair of optical couplers. The optical switch attenuates the optical signal in response to opening or closing of the remote door, and the optical power level receiver is configured to detect an attenuated optical signal and notify the microcontroller of the existence of an attenuated optical signal.

According to other embodiments of the present invention, a remote door access monitoring system includes a central monitoring component and a remote monitoring component. The central monitoring component includes an optical source, an optical power level receiver, and a microcontroller. The optical power level receiver is in communication with the microcontroller. The remote monitoring component includes an optical switch operably associated with a door that is located at a geographical location different from a geographical location of the central monitoring component. The optical source transmits a continuous light signal from the optical source to the optical switch via a first optical fiber, and from the optical switch to the optical power level receiver via a second optical fiber. The optical switch attenuates the optical signal in response to opening or closing of the remote door, and the optical power level receiver is configured to detect an attenuated optical signal and notify the microcontroller of the existence of an attenuated optical signal.

DETAILED DESCRIPTION

Figure 1:
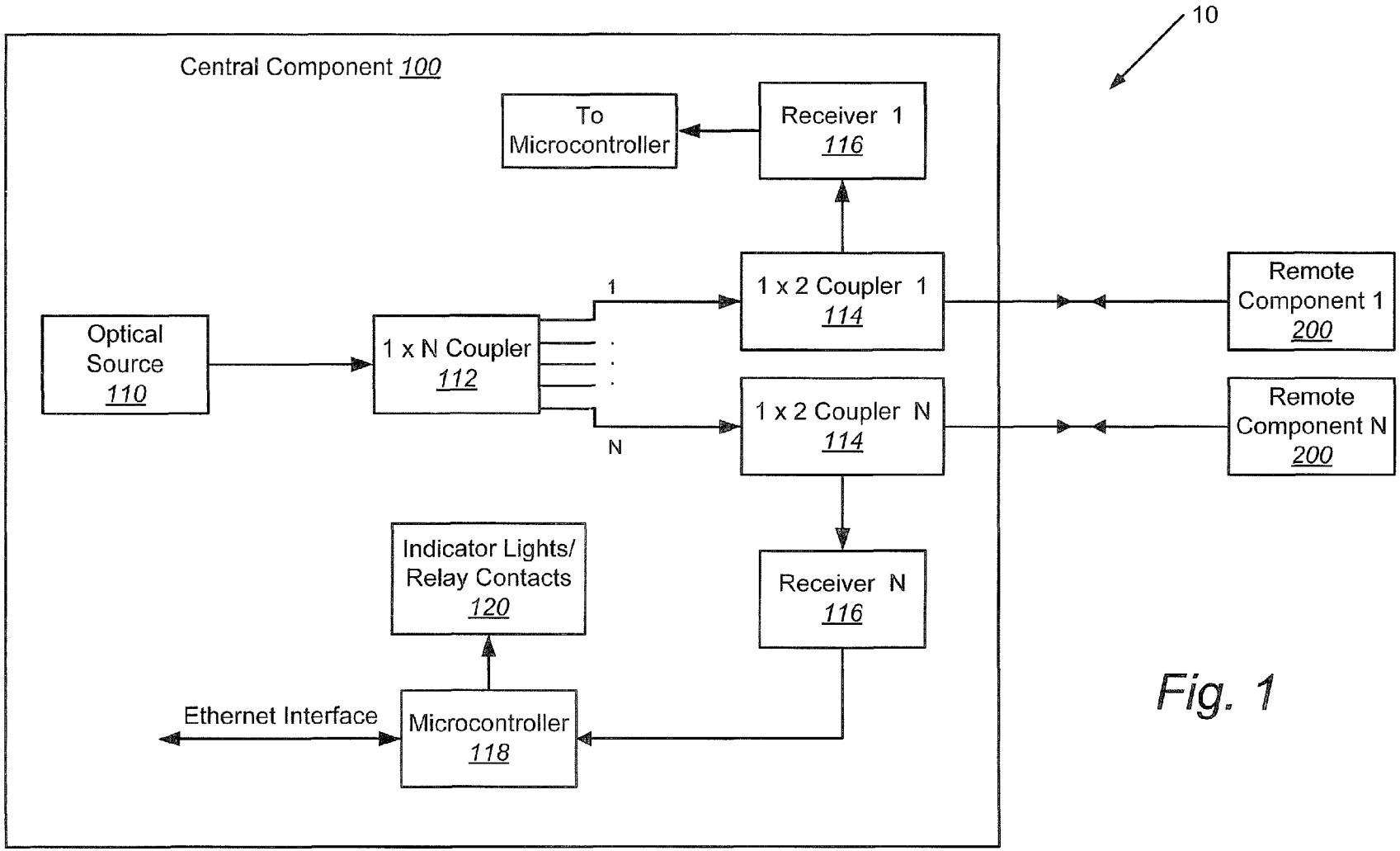
FIG. 1 is a block diagram illustrating a "one optical fiber" remote door access sensing system, according to some embodiments of the present invention.

The present invention now is described more fully hereinafter with reference to the accompanying drawings, in which some embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present.

It will be understood that, although the terms "first", "second", etc. may be used herein to describe various elements, components, optical fibers, couplers, switches, receivers, etc., these elements, components, optical fibers, couplers, switches, receivers, etc. should not be limited by these terms. These terms are only used to distinguish one element, component, optical fiber, coupler, switch, receiver, etc. from another element, component, optical fiber, coupler, switch, receiver. Thus, a "first" element, component, optical fiber, coupler, switch, receiver discussed below could also be termed a "second" element, component, optical fiber, coupler, switch, receiver without departing from the teachings of the present invention. In addition, the sequence of operations (or steps) is not limited to the order presented in the claims or figures unless specifically indicated otherwise.

Figure 3:
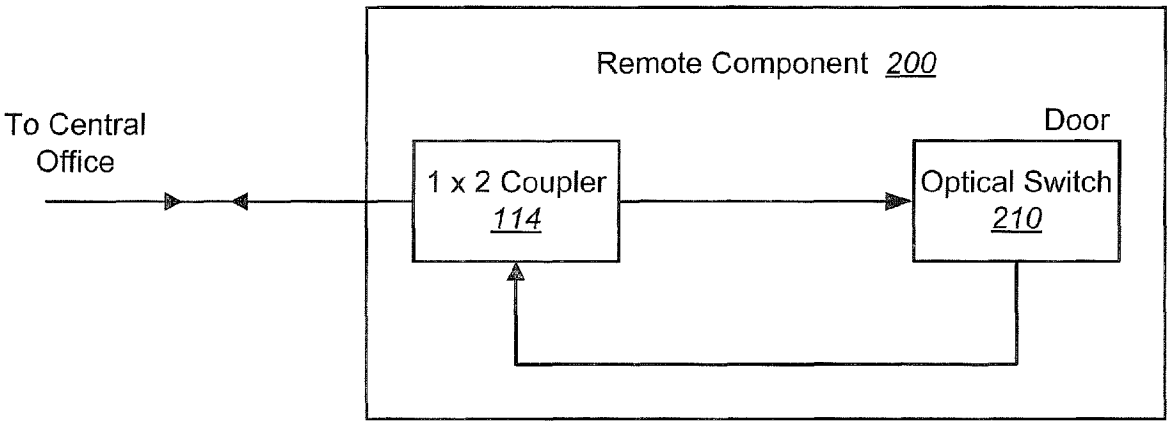
FIG. 3 is a block diagram illustrating a single door monitored via the "one optical fiber" remote door access sensing system of FIG. 1.
Figure 4:
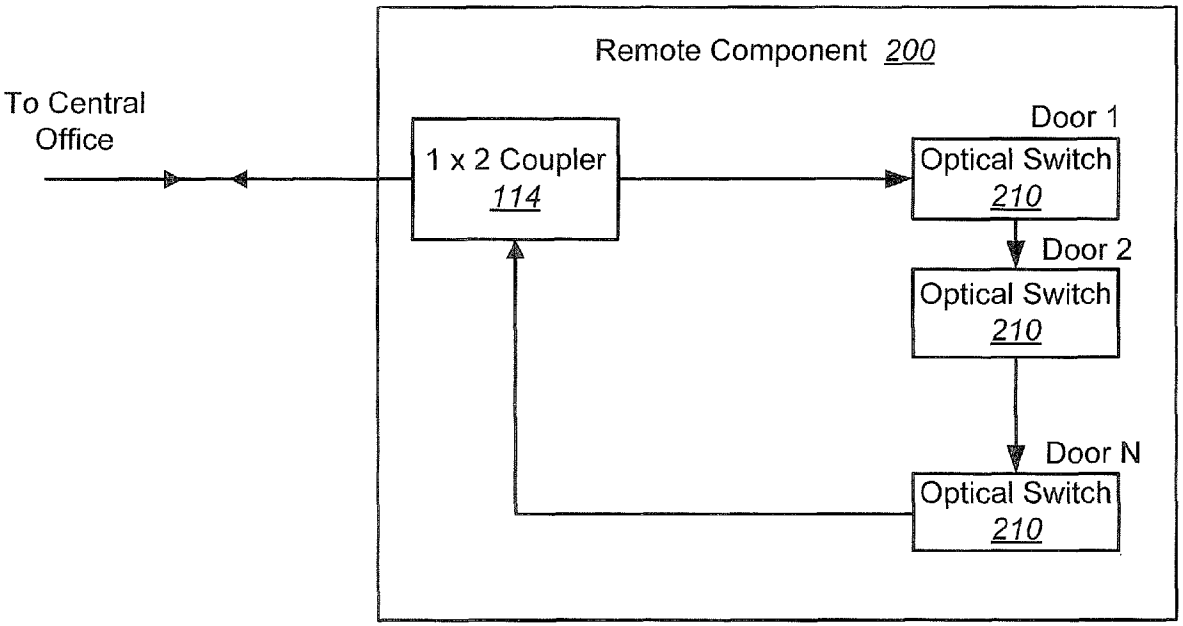
FIG. 4 is a block diagram illustrating multiple doors monitored via the "one optical fiber" remote door access sensing system of FIG. 1.

Referring initially to FIGS. 1, 3 and 4, a remote door access sensing system 10, according to some embodiments of the present invention, is illustrated. The system 10 is used to remotely monitor the status of doors in a remote cabinet/enclosure (e.g., whether a remote door has been opened or closed). The system 10 includes a central monitoring component 100 and at least one remote monitoring component 200. The central monitoring component 100 is typically located in a central office or data center location and includes an optical source 110, various optical couplers 112, 114, optical power level 5 receivers 116, and a microcontroller 118. The remote monitoring component 200 includes an optical switch 210 associated with each monitored door of a remotely located cabinet/enclosure and an optical coupler 114. The central monitoring component 100 and remote monitoring component 200 are connected to one another by one fiber optic cable.

As known to those skilled in the art of the present invention, an optical switch is a switch that enables optical signals in an optical fiber to be selectively switched from one circuit to another. Each optical switch 210, according to embodiments of the present invention, is configured to alter or attenuate a light signal in an optical fiber as a result of the opening and closing of a remote door. Various types of optical switches may be utilized in accordance with embodiments of the present invention. For example, optical switch 210 may operate by mechanical means, such as physically bending an optical fiber or interrupting the beam of a free space collimated light path, etc.

Optical source 110 may be a laser, a light emitting diode (LED), or any other source capable of producing an optical signal (e.g., continuous, patterned, etc.).

As known to those skilled in the art of the present invention, an optical power level receiver is configured to extract information that has been placed on a light carrier. According to embodiments of the present invention, an optical power level receiver 116 extracts information placed on the light carrier by a respective remote switch 210.

Microcontroller 118 may include a clock for providing a time reference for each opening and closing of a remote door. Microcontroller 118 may include a memory (e.g., a non-volatile random access memory) that stores the occurrence and time of each opening and closing event.

FIG. 3 illustrates a remotely located cabinet/enclosure having only one monitored door. FIG. 4 illustrates a remotely located cabinet/enclosure having a plurality of monitored doors. Each remote optical switch 210 is operated by some physical motion such as the opening or closing of a door with which the optical switch 210 is associated. Each optical switch 210 is configured to either pass or attenuate an optical signal transmitted through a respective optical fiber from the optical source 110 in the central monitoring component 100.

The embodiment illustrated in FIGS. 1, 3 and 4 is referred to as a "one optical fiber" configuration. In the "one optical fiber" configuration, a 1×2 directional coupler 114 is located at or near each remote optical switch 210 (FIGS. 3, 4) and another 1×2 coupler 114 is located in the central monitoring component 100 (FIG. 1). These couplers 114 allow bidirectional operation on a single optical fiber. The optical signal from door 1 loops through each additional "downstream" remote door switch 210 prior to returning to the Central Office (Central Component 100). For example, as illustrated in FIG. 4, the optical signal from door 1 loops through each respective remote door switch 210 for door 2 through door N.

Similarly, the optical signal from door 2 loops through each respective downstream remote door switch 210 through door N.

The optical source 110 can be connected to a single remote optical switch 210 via an optical fiber or can be split through a 1×N optical coupler 112 in order to send an optical signal to a number of remote optical switches 210, as illustrated in FIG. 1. In some embodiments, the value of N is 8; however, embodiments of the present invention are not limited to this value of N. N can have various values. In the embodiment illustrated in FIG. 1, the output of the 1×N optical coupler 112 is connected to a respective 2×1 optical coupler 114. The returning optical signal from a remote optical switch 210 is connected to an optical power level receiver 116 via coupler 114. The optical power level receiver 116 is configured to detect an attenuated signal from a remote optical switch caused by opening and/or closing of a remote door. The optical power level receiver 116 outputs an electrical signal which indicates whether or not a door opening or closing event has occurred. The optical power level receiver output voltage changes are proportional to the optical attenuation produced by the door optical switch. The analog to digital converter in the microcontroller analog inputs detects and processes these changes.

The electrical output of each optical power level receiver 116 is connected to an analog input of the microcontroller 118. There may be multiple optical power level receivers 116 connected to the same microcontroller 118. This configuration is advantageous because it can reduce system cost by using the same microcontroller function multiple times. The microcontroller 118 is configured to send the desired cabinet alarm signals to an administration system using a method such as an electronic mail (e-mail) message (e.g., via an ethernet or other interface associated with the microcontroller 118). Additionally the alarm information can be reported as door intrusion relay contact closure and/or alarm indicator lights 120 at the central office or data center.

Figure 2:
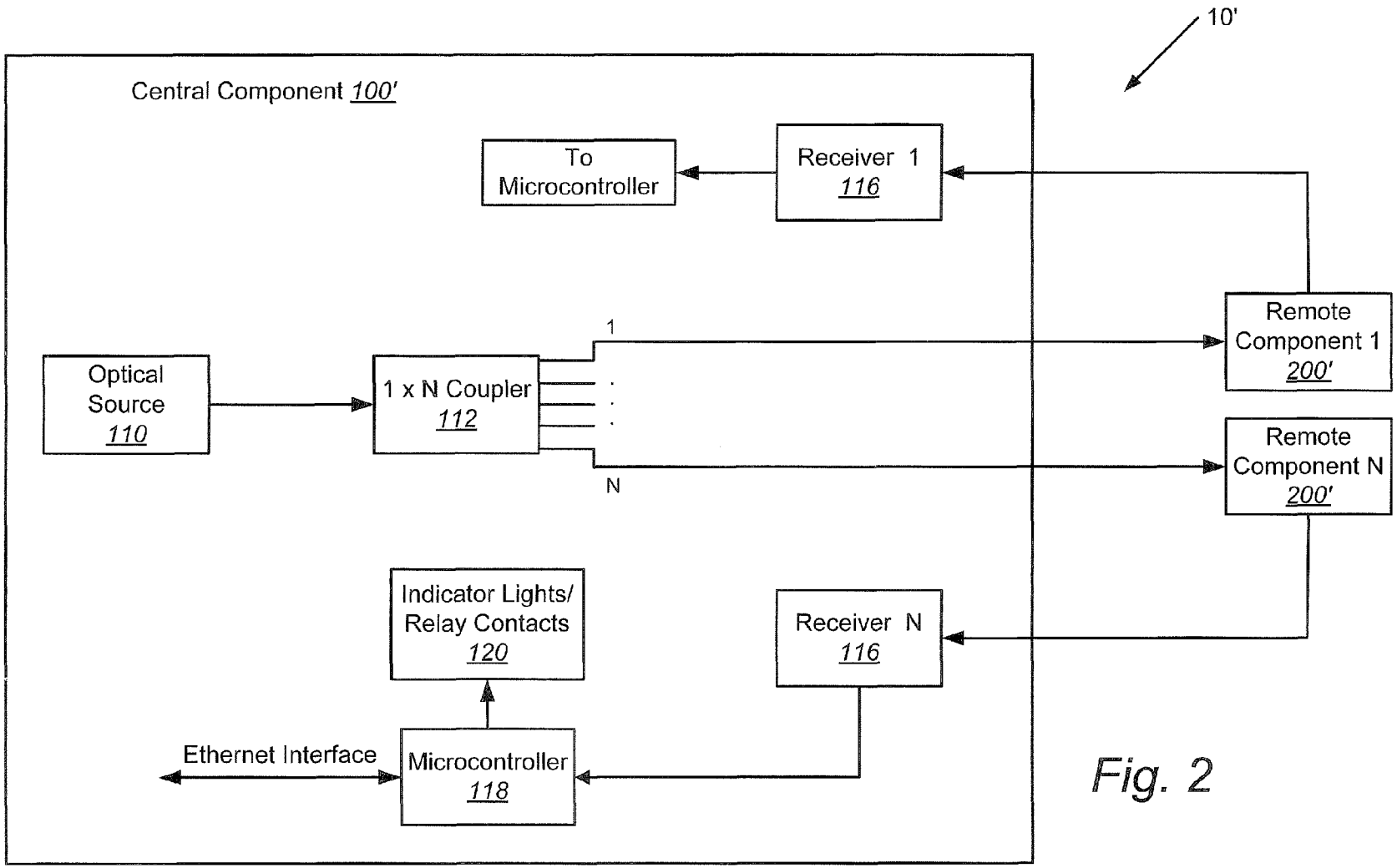
FIG. 2 is a block diagram illustrating a "two optical fiber" remote door access sensing system, according to other embodiments of the present invention.
Figure 5:
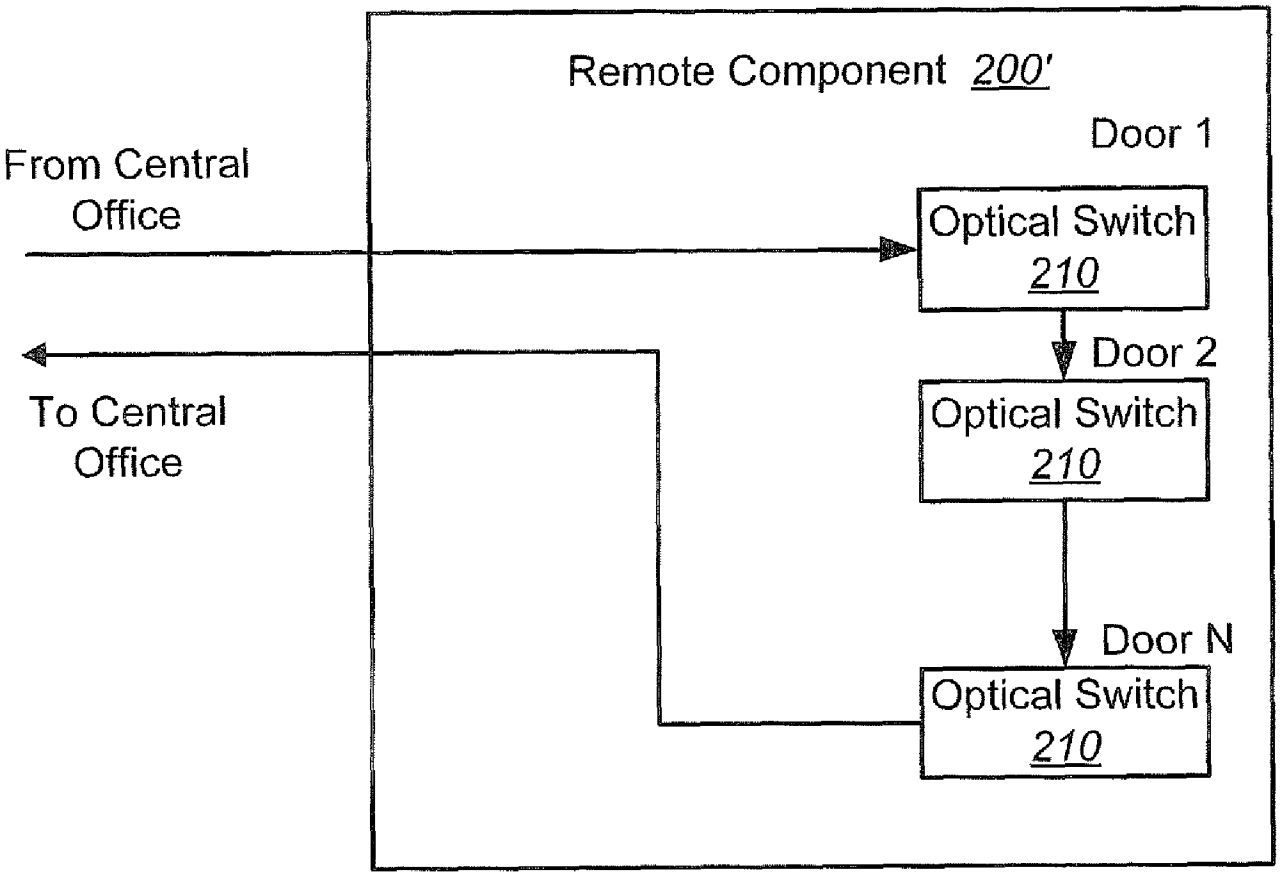
FIG. 5 is a block diagram illustrating multiple doors monitored via the "two optical fiber" remote door access sensing system of FIG. 2.

Referring to FIGS. 2 and 5, a remote door access sensing system 10', according to other embodiments of the present invention, is illustrated. The system 10' is used to remotely monitor the status of doors in a remote cabinet/enclosure (e.g., whether a remote door has been opened or closed). The system 10' includes a central monitoring component 100' and a remote monitoring component 200'. The central monitoring component 100' is typically located in a central office or data center location and includes an optical source 110, optical power level receivers 116 and a microcontroller 118. The central monitoring component 100' may include an optical coupler 112 in order to send an optical signal to a plurality of remote optical switches 210. The remote monitoring component 200' includes an optical switch 210 associated with each door of a remotely located cabinet/enclosure. The central monitoring component 100' and remote monitoring component 200' are connected to one another by two fiber optic cables. One optical fiber carries the optical signal to the remote switch 210 and the other optical fiber is the return signal path that communicates directly to an optical power level receiver 116 without requiring an optical coupler. The illustrated embodiment of FIGS. 2 and 5 is referred to as a "two optical fiber" configuration. The optical signal from door 1 loops through each additional "downstream" remote door switch 210 prior to returning to the Central Office (Central Component 100'). For example, as illustrated in FIG. 5, the optical signal from door 1 loops through each respective remote door switch 210 for door 2 through door N. Similarly, the optical signal from door 2 loops through each respective downstream remote door switch 210 through door N.

The returning optical signal from a remote optical switch 210 is connected to an optical power level receiver 116. The electrical output of each optical power level receiver 116 is connected to an analog input of the microcontroller 118. The microcontroller 118 is configured to send the desired cabinet alarm signals to an administration system using a method such as an electronic mail (e-mail) message (e.g., via an ethernet or other interface associated with the microcontroller 118). Additionally the alarm information can be reported as door intrusion relay contact closure and/or alarm indicator lights 120 at the central office or data center.

The term "remote", as used herein means that a cabinet/enclosure door being monitored is located at a different location than the location of the central monitoring component 100, 100'. For example, the door may be located at a geographical location that is different from the geographical location of the central monitoring component 100, 100'. This may include a door being located in a different room of a building, on a different floor of a building, in a different building, in a different city, etc.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A remote door access monitoring system, comprising:

a central monitoring component comprising an optical source, a first optical coupler, an optical power level receiver, and a microcontroller, wherein the optical power level receiver is in communication with the microcontroller, wherein the first optical coupler is in optical communication with the optical power level receiver; and a remote monitoring component comprising a second optical coupler, and a plurality of optical switches, each optical switch operably associated with a respective door that is located at a geographical location different from a geographical location of the central monitoring component, wherein the second optical coupler is in optical communication with the plurality of optical switches;

wherein the first and second optical couplers are connected to one another by a single optical fiber and facilitate bidirectional optical communication on the optical fiber;

wherein the optical source transmits an optical signal from the optical source to the optical switches and back to the optical power level receiver via the first and second optical couplers, wherein the optical signal passes through each of the optical switches before returning back to the optical power level receiver, wherein each optical switch attenuates the optical signal in response to opening or closing of a respective remote door, and wherein the optical power level receiver is configured to detect an attenuated optical signal from each of the optical switches and notify the microcontroller of the existence of an attenuated optical signal.

2. The system of claim 1, wherein the door is a door of a communications equipment cabinet.

3. The system of claim 1, wherein the microcontroller sends an alarm signal to an administration system in response to receiving notification of an attenuated signal from the optical power level receiver.

4. The system of claim 3, wherein the microcontroller sends an alarm signal to the administration system via electronic mail (e-mail).

5. The system of claim 3, wherein the microcontroller activates a door intrusion relay contact closure and/or an alarm indicator light in response to receiving notification of an attenuated signal from the optical power level receiver.

* * * * *